US007062867B2

(12) United States Patent
Meibock

(10) Patent No.: US 7,062,867 B2
(45) Date of Patent: Jun. 20, 2006

(54) APPARATUS, SYSTEM, AND METHOD FOR SECURING A FOOT IN FOOTWEAR

(75) Inventor: Antonin A. Meibock, Calgary (CA)

(73) Assignee: Kor Hockey, Ltd., Alberta (CA)

( * ) Notice: Subject to any disclaimer, the term of this patent is extended or adjusted under 35 U.S.C. 154(b) by 0 days.

(21) Appl. No.: 10/729,820

(22) Filed: Dec. 5, 2003

(65) Prior Publication Data

US 2004/0181973 A1 Sep. 23, 2004

Related U.S. Application Data

(60) Provisional application No. 60/443,449, filed on Jan. 28, 2003.

(51) Int. Cl.
*A43C 11/20* (2006.01)

(52) U.S. Cl. ..... 36/50.1; 36/58.5; 36/58.6; 36/50.5; 36/54

(58) Field of Classification Search ..... 36/58.5, 36/58.6, 50.1, 50.5, 89, 54
See application file for complete search history.

(56) References Cited

U.S. PATENT DOCUMENTS

| | | | | |
|---|---|---|---|---|
| 3,456,366 | A * | 7/1969 | Boeing | 36/58.5 |
| 5,269,078 | A * | 12/1993 | Cochrane | 36/93 |
| 5,357,695 | A | 10/1994 | Lu | |
| 5,379,529 | A * | 1/1995 | Smith et al. | 36/54 |
| 5,992,057 | A * | 11/1999 | Monti | 36/89 |
| 6,073,370 | A * | 6/2000 | Okajima | 36/50.1 |
| 6,839,985 | B1 * | 1/2005 | Bettiol | 36/54 |
| 2002/0133979 | A1 * | 9/2002 | Gantier | 36/72 R |
| 2004/0181973 | A1 * | 9/2004 | Melbock | 36/50.5 |

FOREIGN PATENT DOCUMENTS

| | | |
|---|---|---|
| EP | 0117372 | 7/1983 |
| EP | 0551704 | 7/1992 |
| EP | 0679346 | 4/1995 |
| EP | 0765914 | 9/1996 |
| EP | 734662 A1 * | 10/1996 |
| FR | 2668072 | 10/1990 |
| WO | WO 95/15094 | 6/1995 |

* cited by examiner

*Primary Examiner*—Ted Kavanaugh
(74) *Attorney, Agent, or Firm*—Black Lowe & Graham PLLC; Darren J. Jones

(57) ABSTRACT

Apparatuses and methods for securing a foot in a footwear item and a footwear item using the apparatus are provided. Pivot members are disposed on opposing sides of a closure configured to secure an opening in an upper of the footwear item, the pivot members being positioned on a surface of the footwear item between the opposing sides of the closure and a heel section of the footwear item. A securing including end sections and a force member is provided. Each of the end sections includes a fastener-receiving opening configured for a fastener to pass therethrough. The force member extends from the end sections and curves around the pivot members to engage the closure. Tension applied to the fastener applies force to the end sections resulting in tension in the force member causing a securing force being applied against the closure.

16 Claims, 4 Drawing Sheets

APPARATUS, SYSTEM, AND METHOD FOR SECURING A FOOT IN FOOTWEAR

PRIORITY CLAIM

This invention claims priority from U.S. Provisional Application No. 60/443,449, filed Jan. 28, 2003.

FIELD OF THE INVENTION

This invention relates generally to footwear and, more specifically, to closing and securing of footwear.

BACKGROUND OF THE INVENTION

Many forms of athletic footwear have improved over the past several decades. Only a few decades ago, for example, state of the art basketball shoes had flat rubber bottoms and a flat, canvas high-topped upper. However, as the benefits of exercise are more widely appreciated, the athletic footwear industry has become a multi-billion dollar per year industry. For example, basketball shoes now routinely cost more than $100 per pair. To compete in this industry, manufacturers continually develop improved designs. Some of these designs are directed to providing a better fit to provide additional comfort and support, or to provide a performance advantage. One design, for example, included air bladders fitted within the upper of the shoe. The air bladders were coupled with a small, manually-actuated pump allowing a wearer to selectively inflate the air bladders to attain a desired fit.

By contrast, design of skate boots has changed little over the course of the last century even though figure skating, speed skating, and ice hockey, have become increasingly popular. As hockey becomes more popular, better, faster, stronger and larger athletes are playing hockey, and these athletes seek increasingly better equipment to attain every possible advantage in competition. As a result, more responsive and supportive skates are desired.

Skating tends to put tremendous stress on a skater's ankles, and ankle support is important to a skater. Conventionally, a skater typically can do one thing to maximize the support available from his or her skates: tighten the laces. Tightening the laces deforms the upper of the skate against the wearer's foot and ankle, securing the upper to the foot and ankle of the wearer to provide support.

The time-tested technique of tightening the laces leaves a number of shortcomings. First, laces stretch or can become loosened, and the support gained from tightening the laces is lost. Second, tightening the laces can be an arduous process. Pulling on the laces loop-by-loop as is required to tightly secure the laces is hard on the fingers of the skater, if the skater can even fit his or her fingers into the loops as desired to effect a desired tightness. Tightening the laces by hand can be so hard on a skater's fingers that skate shops market lace tighteners having a hook supported by a handle that a skater can use to pull on the laces to tighten them. Third, even if a user can tighten the laces to a desired degree of tightness, the tightness of the laces tends to be uniform across the upper of the skate. A skater may desire to tighten the laces particularly at the base of the ankle to keep his or her heel secured in a heel portion of the skate to maintain control of the skate. Unfortunately, to achieve this tension, the laces may be undesirably tight across the skater's or at the top of the upper, uncomfortably cutting into the ankle of the skater.

Thus, there are unmet needs in the art for securing a skate to an ankle of the wearer to provide both comfort and responsiveness.

SUMMARY OF THE INVENTION

Embodiments of the present invention provide apparatuses, a system, and a method for a footwear item to apply pressure to a foot and ankle of a wearer to secure the wearer's heel in place in the footwear. The securing apparatus works with a conventional lace or a separate closure line to apply a securing force on a front of the wearer's foot and ankle to direct the heel in place. In one embodiment of the invention, ends of a strap or similar force member receives a lace or other closure line on opposing sides of a closure securing an opening in an upper of the footwear. The strap extends away from the closure and winds around a pivot member and back across the closure. The pivot members act as pulleys such that tightening of the lace or closure line pulls the strap around the pivot members, and applies an enhanced securing force against the closure. The securing force applied against the closure helps to secure the foot and ankle of the wearer in place. As a result, the footwear is more supportive and responsive to the wearer's movements.

More particularly, embodiments of the invention provide apparatuses and methods for securing a foot of a wearer in a footwear item and a footwear item using a securing apparatus. Pivot members are disposed on opposing sides of a closure configured to secure an opening in an upper of the footwear item, the pivot members being positioned on a surface of the footwear item between the opposing sides of the closure and a heel section of the footwear item. A securing including end sections and a force member is provided. Each of the end sections includes a fastener-receiving opening configured for a fastener to pass therethrough. The force member extends from the end sections and curves around the pivot members to engage the closure. Tension applied to the fastener applies force to the end sections resulting in tension in the force member causing a securing force being applied against the closure.

In accordance with further aspects of the present invention, each of the pivot members includes at least one pivot slot formed in the surface of the footwear item. In one embodiment, each of the pivot members includes a single pivot slot in the surface of the footwear item, such that the force member extends from the end sections, enters beneath the surface of the footwear item, and curves around the single pivot slot toward the closure. In another embodiment of the invention, each of the pivot members includes a pair of pivot slots in the surface of the footwear item, such that the force member extends from the end sections, enters beneath the surface of the footwear item, and curves toward the closure at a first pivot slot, and the force member extends outside the surface of the footwear item and continues extending toward the closure at a second pivot slot. In still another embodiment of the invention, each of the pivot members includes a ring mounted on the outer surface of the footwear item, such that the force member extends from the end sections and curves around the ring toward the closure. In one embodiment, each of the pivot members is further secured to a securing harness, the securing harness including a heel strap extending between the rings beneath the heel and an Achilles strap extending between the rings around an Achilles region.

In accordance with other aspects of the present invention, the force member includes a strap and the fastener-receiving openings are formed by folding back ends of the strap and attaching the ends of the strap to a body of the strap. Alternatively, each of the end sections includes a loop coupled to ends of the force member.

In accordance with still further aspects of the present invention, embodiments of the present invention further comprise a retaining mechanism configured to maintain the force member at a predetermined position relative to the closure. In one form of the invention, the retaining mechanism removably secures the force member at the predetermined position. The retaining mechanism may include a positioner disposed on the force member and a plurality of limiters disposed on opposing sides of the predetermined position and configured to engage the positioner to secure the force member at the predetermined position. The positioner may include a widened element disposed on the force member, and each of the limiters includes a guide having an inner width narrower than an outer width of the widened element. Thus, once the widened element is installed between the guides, the widened element can be removed from between the guides only with application of a removal force sufficient to deform at least one of the widened element or at least one of the guides. The widened element is installable between the guides by deforming at least one of the widened element and one of the guides.

Further in accordance with aspects of the present invention, embodiments of the present invention include a force distribution member configured to receive the securing force applied on the closure by the force member and distribute the securing force over an area wider than a width of the force member. The distribution panel may be integrated within the closure or integrated with the force member. The force distribution member also may include a distribution panel disposed between the force member and an interior surface of the closure, with the distribution panel having a panel width wider than the width of the force member. The distribution panel includes at least a semi-rigid material. The distribution panel member may include at least one of an impact shield, a flex limiter, and an energy return panel substantially covering the closure.

In accordance with other aspects of the present invention, the fastener is a first closure line configured to secure the closure on the footwear item, where the fastener includes one of a lace or a cable. Alternatively, the fastener is a second closure line separate from the first closure line. The fastener may include a securable strap, such as a strap member with a buckle.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, embodiments of the invention provide apparatuses and methods for securing a foot of a wearer in a footwear item and a footwear system using a securing apparatus. Pivot members are disposed on opposing sides of a closure configured to secure an opening in an upper of the footwear item, the pivot members being positioned on a surface of the footwear item between the opposing sides of the closure and a heel section of the footwear item. A securing including end sections and a force member is provided. Each of the end sections includes a fastener-receiving opening configured for a fastener to pass therethrough. The force member extends from the end sections and curves around the pivot members to engage the closure. Tension applied to the fastener applies force to the end sections resulting in tension in the force member causing a securing force being applied against the closure.

Figure 1:
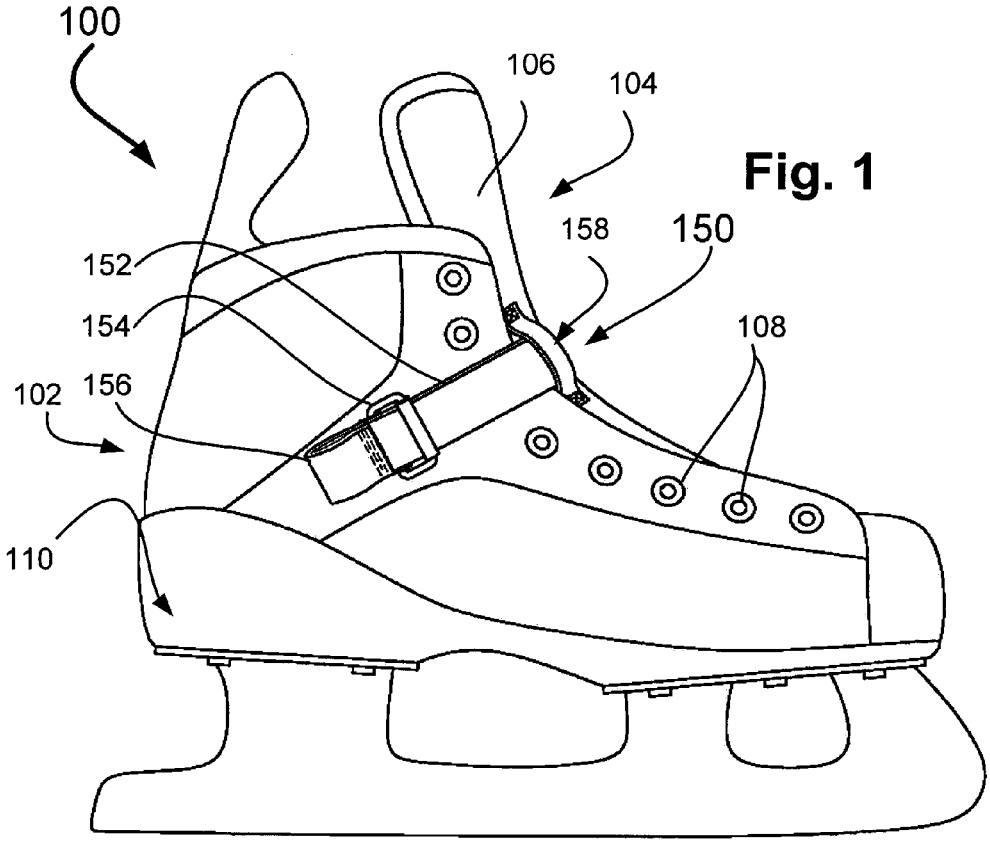
FIG. 1 is a side elevational view of a hockey skate using a securing mechanism according to an embodiment of the present invention in an unsecured position.

FIG. 1 is a side elevational view of a hockey skate 100 using a securing mechanism 150 according to an embodiment of the present invention in an unsecured position. Although the figures show the securing mechanism 150 being used with a hockey skate 100, it will be appreciated that the securing mechanism suitably is usable with other types of skates, ski boots, athletic footwear, and other forms of footwear.

The skate 100 includes an upper 102 having an opening 104 for receiving a foot and ankle of a wearer. The opening 104 includes a closure 106 configured to close the opening 104. The closure 106 is a tongue, although the closure could be a flap extending over or beneath the upper 102, or take another form. A lacing system 108 receives a lace (not shown) that conventionally criss-crosses over the closure 106 once the wearer has donned the skate. Once the wearer laces the skate 100, pressure is applied across the upper 102 and the closure 106 of the skate 100 to secure the wearer's foot into the skate 100. The closure 106, secured by the lace, applies some pressure to the foot of the wearer to secure a heel of the wearer's foot into a heel portion 110 of the skate Generally, the securing mechanism 150 includes a force member 152, such as a strap, which extends across the closure 106. The force member 152 extends through and wraps around a plurality of pivot members 154. After passing through the pivot members 154, the force member ends in a pair of fastener-receiving openings 156 which engage a fastener such as the lace (not shown) or another fastener to activate the securing mechanism 150, as will be further described below. The force member 152 is held in place by a retaining mechanism 158, which also will be further described below.

The pivot members 154 can include a number of forms. In one embodiment of the invention, the force member 152 may extend from the closure 106 beneath the upper 102 and extend through and pivot around a single pivot slot in the upper 102. Alternatively, the force member 152 may extend from the closure 106 across an outer surface of the upper 102, slip beneath a surface of the upper 102 through a first pivot slot in the upper, then extend through and pivot around a second pivot slot in the upper 102. Further alternatively, and as shown in FIGS. 1–4, rings, such as D-rings, suitably are coupled with the upper through which the force member 152 can pivot. The rings suitably are rounded rings, plain D-rings, or D-rings that include a rotating sleeve to facilitate pivoting of the force member 152. In any form, the pivot members 154 provide a pulley-like fulcrum for the force member 152 such that the force member 152 can redirect a tensioning force applied by a fastener such as a lace (not shown) or a separate fastener as will be further described below. Because an object of one embodiment of the present invention is to apply a force to the closure 106 to secure a foot and ankle of the wearer into a heel section 110 of the upper 102, the pivot members 154 should be positioned on the upper 102 at a location such that the force member 152 directs a securing force toward the heel section 110 of the skate 100.

The fastener engaging ends 156 of the force member 152 may be formed by joining end pieces, such as rings, to the force member 152. Alternatively, and as shown in FIGS. 1–4, if the force member 152 is a trap, the fastener engaging ends 156 suitably are formed by doubling ends of the strap back onto the strap themselves and bonding the free ends of the strap to the body of the strap to define the fastener-receiving openings 156.

Figure 2A:
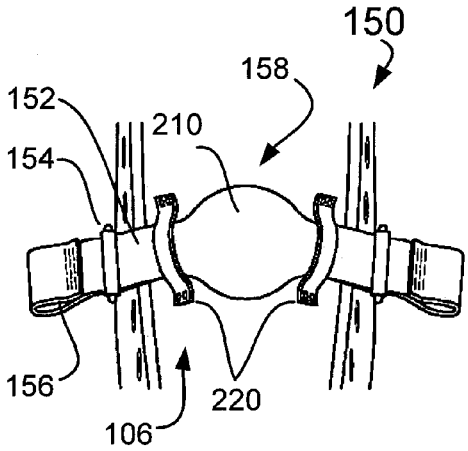
FIG. 2A is a top perspective view detail view of the securing mechanism in an unsecured position to show a retaining mechanism.

FIG. 2A is a top perspective detail view of the securing mechanism 150 in an unsecured position and two different embodiments of the strap retaining mechanism. It is desirable to keep the force member 152 in a desired position over the closure 106 to direct a securing force generated by the securing mechanism 150 to a desired location. The strap retaining mechanism also is desirable to keep the force member 152 from sliding out of place and being lost when a lace (not shown) is removed from the skate 100 (FIG. 1).

FIG. 2A shows an embodiment of a retaining mechanism 158. The retaining mechanism 158 includes a widened element 210 of the force member 152 situated between two guides 220. Once the force member 152 is slid into place by deforming or forcing the widened element 210 into place between the guides 220, or the widened element 210 is positioned and the guides 220 secured in place over the widened area 210, the force member 152 is retained in position relative to the closure 106. As a result, the force member 152 will direct force to a predetermined location on the closure 106 when engaged. Also, the force member 152 will not be able to accidentally slide off the skate 100.

It will be appreciated that the retaining mechanism 158 shown in FIG. 2A allows for the force member 152 to be installed, removed, and replaced as desired. The force member 152 may be removed from its predetermined position only when a removal force sufficient to deform one of the widened element 210 and/or at least one of the guides 220 to allow the widened element 210 to pass through one of the guides 220. Similarly, the force member may be replaced by application of an insertion or installation force sufficient to deform one of the widened element 210 and/or at least one of the guides 220 to allow the widened element 210 to pass through one of the guides 220.

Figure 2B:
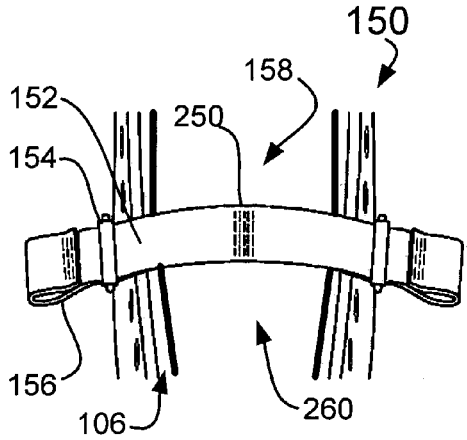
FIG. 2B is a top perspective view detail view of the securing mechanism in an unsecured position to show another embodiment of a retaining mechanism.

FIG. 2B shows another embodiment of a retaining mechanism 158. The retaining mechanism 158 includes a bonding mechanism 250, such as stitching or adhesive bonding joining the force member 152 to a removable panel 260. The removable panel 260 is in the nature of an impact shield, a flex limiter, and/or an energy return device. The removable panel 650 includes at least a semi-rigid material. As will be described below, the removable panel 260 is configured to receive a securing force applied on the closure 106 by the force member 152 and distributes the securing force 500 over an area wider than a width of the force member 152. Moreover, the removable panel 260 provides additional benefits. As an impact shield, the removable panel 260 provides protection for the wearer. As a flex limiter, the removable panel 260 provides support to the wearer. Also, as an energy return device, as a deforming force is applied to the removable panel 260, a responsive force is generated by the removable panel 260 to return energy expended by the wearer to the wearer. Once the force member 152 is secured in place by the bonding mechanism 250, the force member 152 will direct force to a predetermined location on the closure 106 when engaged. Also, the force member 152 will not be able to accidentally slide off the skate 100. The force member 152 suitably is fixably or removably attached to the removable panel 260, so that the force member 152 and/or the removable panel 260 can be removed from the skate 100.

Figure 3:
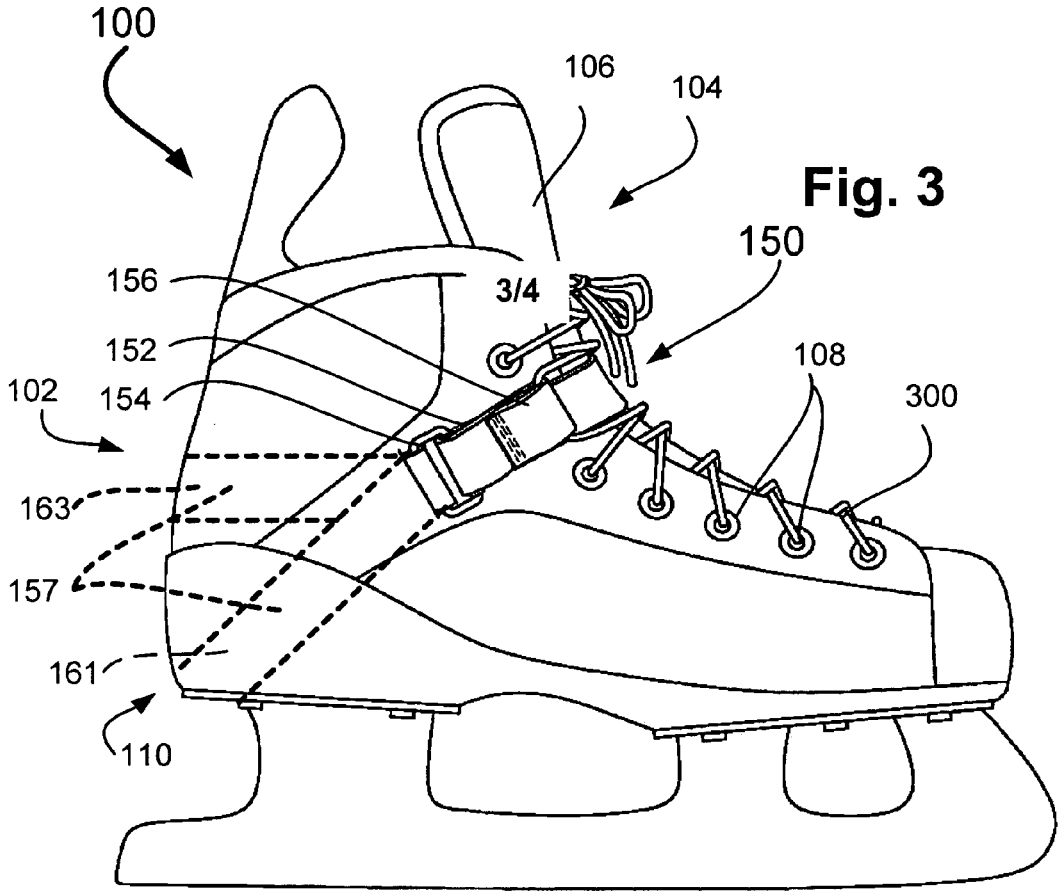
FIG. 3 is a side elevational view of a hockey skate using the securing mechanism in a secured position.

FIG. 3 is a side elevational view of a hockey skate 100 with the securing mechanism 150 in a secured position. FIG. 3 shows how a lace 300, engaging the fastener-receiving openings 156 at end sections of the force member 152 generates a securing force. The lace 300 conventionally engages the lacing system 108 from a front of the skate, criss-crossing the opening 104 in the upper 102 toward a top end of the skate 100. Before reaching a top end of the skate 100, the lace 300 engages each of the fastener-receiving openings 156 on the force member 152. As the lace 300 is tightened, the fastener-receiving ends 156 are pulled toward a center of the opening 104 in the upper 102. The pulling force applied to the fastener-receiving ends 156 creates a tension in the force member 152. The tension is redirected around the pivot members 154 causing the force member 152 to apply a securing force against the closure 106. The closure 106, in turn, applies a securing force to a foot and ankle of the wearer. In other words, the pivot members 154 operate as pulleys, redirecting tension in the force member 152 caused by tension in the lace 300 or other fastener to generate the securing force.

In one embodiment, each of the pivot members 154 is further secured to a securing harness 157. The securing harness 157 includes a heel strap 161 extending between the pivot members 154 beneath the heel. The securing harness 157 also includes an Achilles strap 163 extending between the pivot members 154 around an Achilles region. The securing harness acts to further secure the wearer's foot and ankle into the skate by distributing the force imparted by the securing mechanism 150 such that the wearer's leg is securely drawn into the heel section 110.

Because the pivot members 154 act as pulleys, tension applied to the force member 152 is enhanced in the way that pulleys enhance tension applied to a chain in a block-and-tackle system. Accordingly, tension applied to a fastener such as a lace and then applied to the force member may multiply the tension by as much as a factor of two. Thus, the securing mechanism 150 advantageously applies a strong securing force to the foot of the wearer.

It will be appreciated that the fastener-receiving ends 156 need not engage a lace, cable, or other fastener used to secure the closure 106 on the footwear. A separate fastener can be used to engage the fastener-receiving ends 156 of the securing mechanism 150 to allow the force member 152 to apply a desired securing force independent of what other force may be generated or applied by the footwear fastener. The separate, second fastener suitably includes a second lace or cinching line to engage the fastener-receiving ends 156. Similarly, a strap and buckle system suitably is used.

Figure 4:
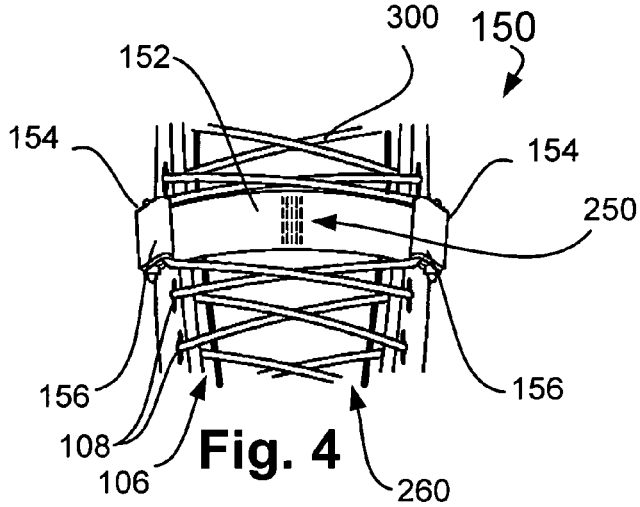
FIG. 4 is a top-front perspective view of a hockey skate using the securing mechanism in a secured position.

FIG. 4 is a top-front perspective view of the skate 100 with the securing mechanism 150 in the secured position. As shown in FIG. 3, the lace 300, engaging the fastener-receiving openings 156 at end sections of the force member 152 generates the securing force. The lace 300 conventionally engages the lacing system 108 from a front of the skate, criss-crossing the opening 104 in the upper 102 toward a top end of the skate 100. Before reaching a top end of the skate 100, the lace 300 engages each of the fastener-receiving openings 156 on the force member 152. As the lace 300 is tightened, the fastener-receiving ends 156 are pulled toward a center of the opening 104 in the upper 102. The pulling force applied to the fastener-receiving ends 156 creates tension in the force member 152. The tension is redirected around the pivot members 154 causing the force member 152, where it contacts the closure 106 to apply a securing force against the closure 106 which, in turn, applies a securing force to a foot and ankle of the wearer. In other words, the pivot members 154 operate as pulleys, redirecting tension in the force member 152 caused by the lace 300 to generate the securing force. As shown in FIG. 4, the force member 152 is secured to the closure 106 by a bonding mechanism 250 to couple the force member to the closure 106 at a predetermined position where the securing force is directed.

Figure 5:
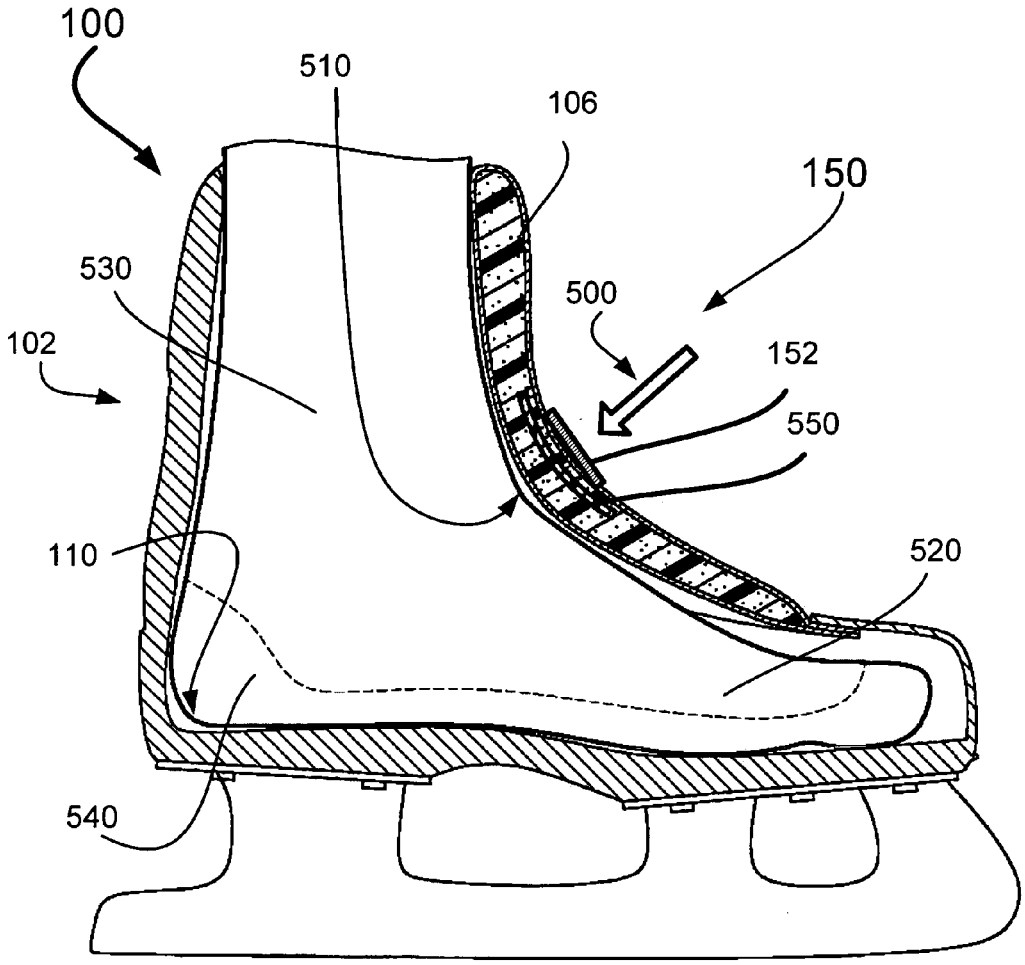
FIG. 5 is a cutaway view of a hockey skate worn by a user with the securing mechanism according to an embodiment of the invention in a secured position.

FIG. 5 is a cutaway view of the skate 100 worn by a user with the securing mechanism 150 in the secured position. The pulling force applied to the lace (not shown) causes the force member 152, where it contacts the closure 106, to apply a securing force 500 against the closure 106 which, in turn, applies the securing force 500 to a front surface 510 of a foot 520 and ankle 530 of the wearer. The securing force 500 thus drives the foot 520 and ankle 530 of the wearer toward the heel section 110 of the skate 100. The securing force 500 thus secures a heel 540 of the wearer into the heel section 110 of the skate 100 to provide added support, control, and responsiveness.

FIG. 5 also shows a force distribution member 550 configured to receive the securing force applied on the closure 106 by the force member 152. The force distribution member 550 distributes the securing force 500 over an area wider than a width of the force member 152. Distributing the securing force over a wider area provides additional stability while reducing possibility of an uncomfortable pressure point being created on the front surface 510 of the foot 520 and/or ankle 530 of the wearer. The distribution panel 550 suitably includes at least a semi-rigid material, and may be integrated with the closure 106 or the force member 252 of the skate 100.

Figure 6:
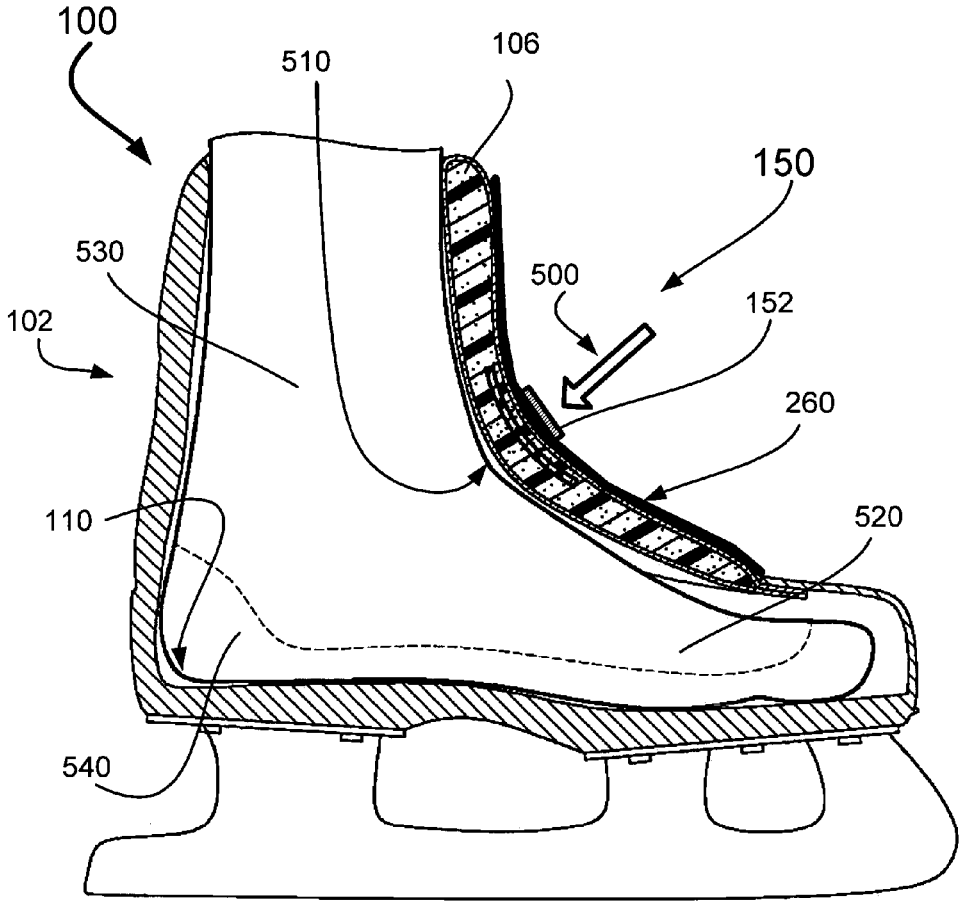
FIG. 6 is a cutaway view of a hockey skate worn by a user with the securing mechanism according to another embodiment of the invention in a secured position.

FIG. 6 is a cutaway view of the skate 100 worn by a user with the securing mechanism 150 in the secured position. FIG. 6 shows a force distribution member 650 external to the closure 106. The force distribution member 650 is in the nature of an impact shield, a flex limiter, or an energy return device. The force distribution member 650 includes at least a semi-rigid material. As a result, the force distribution member is configured to receive the securing force applied on the closure 106 by the force member 152 and distributes the securing force 500 over an area wider than a width of the force member 152, and is further configured to protect the wearer's foot, limit flexure, or return energy in response to applied movements. The force distribution member 650 may be removably installed over the closure 106 with the force member 152 removably or fixably attached to the force distribution member 650, allowing the force distribution member 650 and/or the force member to be removed from the skate 100.

Embodiments of the present invention include the securing apparatus and footwear incorporating the securing apparatus. Embodiments of the present invention also include a method of redirecting fastener tension to secure footwear on a leg of a user by using a force-bearing member to engage a fastener and apply pressure against a closure of a footwear item as previously described in connection with FIGS. 1–5.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. An apparatus for securing a foot of a wearer in a footwear item, the footwear item having an opening to receive a foot disposed generally opposite to a heel section of the footwear item and a closure configured to secure the opening, the apparatus comprising:

a footwear item having an opening to receive the foot disposed generally opposite to a heel section of the footwear item and a tongue including opposing lateral sides configured to close the opening;

at least two pivot members disposed near the opposing lateral sides of the tongue, each of the pivot members being positioned on the footwear item between the opposing lateral sides of the tongue and the heel section; wherein each of the pivot members includes a first pivot slot formed in a surface of the footwear item; and a securing device including:

a plurality of end sections. each of the end sections including a fastener-receiving opening configured for a fastener to pass therethrough; and a removable force member extending from the end sections and configured to curve around the pivot members and engage the tongue such that tension applied to the fastener applies force to the end sections resulting in tension in the force member causing a securing force to be applied against the tongue.

2. The apparatus of claim 1, wherein the force member extends from the end sections penetrates through a surface of the footwear at the first pivot slot-and curves around toward a center line of the tongue at the first pivot slot.

3. The apparatus of claim 1, wherein each of the pivot members further includes a second slot in the surface of the footwear item, such that the force member extends from the end sections, penetrates through the surface of the footwear item, and curving toward the tongue at a first pivot slot, and the force member extends continues extending toward the tongue penetrating through the surface of the footwear item at a second slot.

4. An apparatus for securing a foot of a wearer in a footwear item, the footwear item having an opening to receive a foot disposed generally opposite to a heel section of the footwear item and a closure configured to secure the opening, the apparatus comprising:

a footwear item having an opening to receive the foot disposed generally opposite to a heel section of the footwear item and a tongue including opposing lateral sides configured to close the opening;

at least two pivot, members disposed near the opposing lateral sides of the tongue, each of the pivot members being positioned on the footwear item between the opposing lateral sides of the tongue and the heel section; wherein each of the pivot members includes a first pivot slot formed in a surface of the footwear item; and a securing device including:

a plurality of end sections, each of the end sections including a fastener-receiving opening configured for a fastener to pass therethrough; and a removable force member extending from the end sections and configured to curve around the pivot members and engage the tongue such that tension applied to the fastener applies force to the end sections resulting in tension in the force member causing a securing force to be applied against the tongue;

a retaining mechanism configured to maintain the force member at a predetermined position relative to the tongue; wherein the retaining mechanism removably secures the force member at the predetermined position;

wherein the retaining mechanism includes:

a positioner disposed on the force member; and a plurality of limiters disposed on opposing sides of the predetermined position and configured to engage the positioner to secure the force member at the predetermined position.

5. The apparatus of claim 4, wherein the positioner includes a widened element disposed on the force member and each of the limiters includes a guide having an inner width narrower than an outer width of the widened element such that, once the widened element is installed between the guides, the widened element can be removed from between the guides only with application of a removal force sufficient to deform at least one of the widened element of at least one of the guides.

6. The apparatus of claim 5, wherein the widened element is installable between the guides by deforming at least one of the widened element and one of the guides.

7. An apparatus for securing a foot of a wearer, the apparatus comprising:

a footwear item having an opening to receive a foot disposed generally opposite to a heel section of the footwear item and a tongue including opposing lateral sides configured to secure the opening;

pivot members proximate to opposing lateral sides of the tongue, each of the pivot members being positioned on footwear item between the opposing sides of the tongue and the heel section; and a removable securing device including:

a plurality of end sections, each of the end sections including a fastener-receiving opening configured for a fastener to pass therethrough;

a force member extending from the end sections and configured to curve around the pivot members and engage the tongue such that tension applied to the fastener applies force to the end sections resulting in tension in the force member causing a securing force to be applied against the tongue; and a retaining device configured to removably secure the force member to the footwear item; wherein the retaining device is configured to maintain the force member at a predetermined position relative to the tongue; and wherein each of the pivot members is further secured to a securing harness, the securing harness including a heel strap extending between the pivot members beneath the heel and an Achilles strap extending between the pivot members around an Achilles region.

8. An apparatus for securing a foot of a wearer the apparatus comprising:

a footwear item having an opening to receive a foot disposed generally opposite to a heel section of the footwear item and a tongue including opposing lateral sides configured to secure the opening;

pivot members proximate to opposing lateral sides of the tongue, each of the pivot members being positioned on footwear item between the opposing sides of the tongue and the heel section; and a removable securing device including:

a plurality of end sections, each of the end sections including a fastener-receiving opening configured for a fastener to pass therethrough;

a force member extending from the end sections and configured to curve around the pivot members and engage the tongue such that tension applied to the fastener applies force to the end sections resulting in tension in the force member causing a securing force to be applied against the tongue; and a retaining device configured to removably secure the force member to the footwear item; wherein the retaining device includes:

a positioner disposed on the force member; and a plurality of limiters disposed on opposing sides of the footwear item and configured to engage the positioner to secure the force member to the footwear item.

9. The apparatus of claim 8, wherein the positioner includes a widened element disposed on the force member and each of the limiters includes a guide having an inner width narrower than an outer width of the widened element such that, once the widened element is installed between the guides, the widened element can be removed from between the guides only with application of a removal force sufficient to deform at least one of the widened element of at least one of the guides.

10. The apparatus of claim 9, wherein the widened element is installable between the guides by deforming at least one of the widened element and one of the guides.

11. A footwear system comprising:

a boot, the boot including:

a sole an upper joined to the sole and having an inner surface for encasing a foot of a wearer and an outer surface;

an opening in a face of the upper generally opposed to a heel section of the boot configured to receive a heel of the foot of the wearer the opening having two opposing sides; and a closure configured to secure the opening; and at least two pivot members disposed on the opposing sides of the opening, respectively, each of the pivot members being positioned on a surface of the boot between the opposing sides of the opening e and the heel section; and a removable securing device including:

a plurality of end sections, each of the end sections including a fastener-receiving opening configured for a fastener to pass therethrough; and a force member extending from the end sections and configured to curve around the pivot members and engage the closure such that tension applied to the fastener applies force to the end sections resulting in tension in the force member causing a securing force being applied against the wherein each of the pivot members includes at least one first pivot slot formed in a surface of the footwear item.

12. The system of claim 11, wherein the force member extends from the end sections, penetrates a surface of the footwear item at the first pivot slot, and curves around the first pivot slot toward a centerline of the closure.

13. The system of claim 11, wherein each of the pivot members includes a second slot in the surface of the footwear item, such that the force member extends from the end sections, penetrates the surface of the footwear item the first pivot slot, and curves toward a centerline of the closure at the first pivot slot, and the force member again penetrates the surface of the footwear item at the second slot and continues extending toward the closure at the second slot.

14. A footwear system comprising:

a boot, the boot including:

a sole;

an upper joined to the sole and having an inner surface for encasing a foot of a wearer and an outer surface;

an opening in a face of the upper generally opposed to a heel section of the boot configured to receive a heel of the foot of the wearer the opening having two opposing sides; and a closure configured to secure the opening; and at least two pivot members disposed on the opposing sides of the opening, respectively, each of the pivot members being positioned on a surface of the boot between the opposing sides of the opening e and the heel section; and a removable securing device including:

a plurality of end sections, each of the end sections including a fastener-receiving opening configured for a fastener to pass therethrough; and a force member extending from the end sections and configured to curve around the pivot members and engage the closure such that tension applied to the fastener applies force to the end sections resulting in tension in the force member causing a securing force being applied against the closure;

further comprising a retaining mechanism configured to maintain the force member at a predetermined position relative to a centerline of the closure; wherein the retaining mechanism removably secures the force member at the predetermined position;

wherein the retaining mechanism includes:

a positioner disposed on the force member; and a plurality of limiters disposed on opposing sides of the predetermined position and configured to engage the positioner to secure the force member at the predetermined position.

15. The system of claim 14, wherein the positioner includes a widened element disposed on the force member and each of the limiters includes a guide having an inner width narrower than an outer width of the widened element such that, once the widened element is installed between the guides, the widened element can be removed from between the guides only with application of a removal force sufficient to deform at least one of the widened element of at least one of the guides.

16. The system of claim 15, wherein the widened element is installable between the guides by deforming at least one of the widened element and one of the guides.

* * * * *